United States Patent [19]

Clauss et al.

[11] 3,985,784

[45] Oct. 12, 1976

[54] THIOETHER SULFONATES FOR USE IN ELECTROPLATING BATHS

[75] Inventors: Richard John Clauss, Allen Park; Robert Arnold Tremmel, Woodhaven; Donald Harvey Becking, West Bloomfield, all of Mich.

[73] Assignee: Oxy Metal Industries Corporation, Warren, Mich.

[22] Filed: Mar. 7, 1975

[21] Appl. No.: 556,232

Related U.S. Application Data

[60] Continuation-in-part of Ser. No. 270,352, July 10, 1972, abandoned, which is a division of Ser. No. 176,688, Aug. 31, 1971, Pat. No. 3,703,448, which is a continuation-in-part of Ser. No. 862,942, Oct. 1, 1969, abandoned.

[52] U.S. Cl. ..... 260/465.1; 204/40; 260/465.8 R; 260/513 N

[51] Int. Cl.[2] ..... C07C 121/16; C07C 121/20; C07C 143/13

[58] Field of Search ..... 260/465.1, 465.8 R, 260/513 N, 507 R 465 A

[56] References Cited

UNITED STATES PATENTS

| | | | |
|---|---|---|---|
| 2,330,713 | 9/1943 | Holbrook et al. | 260/513 N X |
| 2,462,406 | 2/1949 | Langkammerer | 260/465.8 R |
| 2,694,718 | 11/1954 | Salminen et al. | 260/507 R X |
| 3,112,198 | 11/1963 | Klinger | 260/507 R X |
| 3,344,174 | 9/1967 | Broussalian | 260/513 N X |
| 3,502,708 | 3/1970 | Thoma et al. | 260/465.1 |
| 3,707,507 | 12/1972 | Williams | 260/465.1 X |
| 3,734,840 | 5/1973 | Passal | 260/465.4 X |

*Primary Examiner*—Joseph Paul Brust
*Attorney, Agent, or Firm*—B. F. Claeboe

[57] ABSTRACT

A composite nickel-containing electroplate is formed on a base metal surface by electroplating on the surface an adherent nickel or nickel alloy layer having a thickness of from about 0.15 to 1.5 mils and an average sulfur content of less than about 0.03%. An intermediate nickel or nickel alloy layer, having a thickness of from about 0.005 to 0.2 mils and an average sulfur content of from about 0.05 to 0.3% is then electroplated on the lower layer. An adherent upper nickel or nickel alloy having a thickness of from about 0.2 to 1.5 mils and average sulfur content of from about 0.02 to 0.15% is then electroplated on the intermediate layer, the upper layer containing a lower percentage of sulfur then the lower layer. The source of sulfur, for at least the intermediate layer, is provided by including novel thioethersulfonates of nitriles or amides in the plating bath for that layer.

7 Claims, No Drawings

THIOETHER SULFONATES FOR USE IN ELECTROPLATING BATHS

CROSS REFERENCE TO RELATED CASES

This case is a continuation-in-part of U.S. Ser. No. 270,352 filed July 10, 1972, (now abandoned) which in turn is a divisional of U.S. Ser. No. 176,688 filed Aug. 31, 1971 (now U.S. Pat. No. 3,703,448 granted Nov. 21, 1972), which in turn is a continuation-in-part of U.S. Ser. No. 862,942 filed Oct. 1, 1969 (now abandoned).

The present invention relates to an improved process for forming a composite electroplate on a metal base and more particularly, it relates to improvements in the method of forming a composite electroplate comprising three types of nickel electroplates which are adjacent or contiguous to each other and to a plating bath useful in this process.

In U.S. Pat. No. 3,090,733, issued May 21, 1963 to Henry Brown, there is described an improved composite electroplate on a base metal which is made up of three types of nickel electroplate that are adjacent or contiguous to each other and the method of preparing this improved composite coating. As disclosed in this patent, this composite electroplate is made up of three adjacent bonded layers of nickel each having a certain thickness with the intermediate layer of nickel having a higher sulfur content than the nickel layers which sandwich it and the upper layer of nickel having an appreciably higher sulfur content than the lower layer.

As is set forth in this patent, various inorganic and organic sulfur containing compounds may be incorporated in the plating baths from which the intermediate and upper nickel layers are produced to provide the desired sulfur content in these layers. Included as examples of the sulfur compounds which may be used are various thiosulfates, sulfites, bisulfites, hyposulfites, hydrosulfites, sulfoxylates, sulfinates, thiocyanates, sulfoxides, sulfonic acids, mercapto aromatic acids, thioureas, thiohydantoins, sulfonamides, sulfonimides, sulfonyl halides, sulfones, and the like.

Although by the process of this patent, greatly improved corrosion protection is obtained, even with a much thinner total thickness of nickel plate, than has heretofore been possible, some difficulties have been encountered with the operation of this process. Thus, when using the sulfur containing additives disclosed in this patent, it is found that the plating baths are sensitive to air agitation, and to high temperatures, thus limiting the speed at which the plating operation can be carried out. Additionally, the electroytic removal of metal contaminates such as zinc, copper and lead, which build up in the plating bath, cannot be effected until the sulfur containing additives have been decomposed by oxidation. This therefore, means that after the removal of these impurities the sulfur compound additives must be replenished in the plating baths before the plating operation can be resumed. This of course, is both time consuming and costly.

It is therefore, an object of the present invention to provide an improved process for forming a three layered composite nickel containing electroplate which may be carried out at faster plating speeds and from which metal impurities may be electrolytically removed, without destroying the sulfur compound additives in the bath.

A further object of the present invention is to provide an improved electroplating bath for use in the present process for forming the three layered composite electroplate.

These and other objects will become apparent to those skilled in the art from the description of the invention which follows.

Pursuant to the above objects, the present invention includes an improvement in the process of forming a composite nickel containing coating on a corrosion susceptible base metal surface by electroplatng on said suface an adherent lower layer of a nickel containing electroplate having a thickness of from about 0.15 mil to 1.5 mils and an average sulfur content of less than about 0.03%, electroplating on said lower layer an adherent intermediate layer of a nickel containing electroplate having a thickness of from about 0.005 to about 0.2 mils and an average sulfur content of from about 0.05 to 0.3% and electroplating on said intermediate nickel containing layer an adherent upper layer of a nickel containing electroplate having a thickness of from about 0.2 to 1.5 mils and an average sulfur content of from about 0.02 to 0.15%, said upper layer containing a lower percentage of sulfur thatn said lower layer, which improvement comprises including at least one thioethersulfonate of nitriles or amides in the electroplating bath as the source of sulfur in at least the intermediate nickel containing layer. By the use of thioethersulfonates of nitriles or amides, rather than other sulfur containing compounds, such as those set forth in U.S. Pat. No. 3,090,733, it is found that the plating baths may be operated with air agitation, and higher temperatures, thus making possible faster plating speeds, and metallic impurities, such as zinc, copper, and lead, may be electrolytically removed from the plating bath without the need for first destroying these sulfur containing compounds by oxidation.

More specifically, in the practice of the present invention, thioethersulfonates of nitriles or amides are incorporated in at least the electroplating bath used for forming the intermediate nickel containing layer, to provide the source of sulfur in the intermediate layer and, preferably, are included in the electroplating baths for both the intermediate and the upper nickel containing layer, to provide the source for the sulfur in these layers. As has been noted hereinabove, sulfur content of the immediate nickel containing layer is desirably within the range of about 0.05 to 0.3% while that in the upper nickel containing layer is desirably within the range of about 0.02 to 0.15%. Accordingly, the thioethersulfonates of nitriles or amides are desirably incorporated in the plating baths used to produce these layers in amounts within the range of about 0.01 to 0.4 grams per liter, with amounts within the range of about 0.03 to 0.1 grams per liter being preferred in the electroplating baths used to produce the intermediate layer and amounts within the range of about 0.01 to 0.04 grams per liter being preferred to the electroplating bath from which the upper layer is produced. Obviously, the exact amount of these thioethersulfonates of nitriles or amides incorporated in the electroplating baths will depend upon the particular compound or compounds which are used, so that in some instances, amounts of these materials which are either greater than or less than the preferred ranges indicated may also be used, so long as the particular amounts of these compounds which are used are sufficient to provide the desired amount of sulfur in the particular nickel containing electroplated layer.

The novel thioethersulfonates of nitriles or amides which may be used in the present process are represented by the following formula:

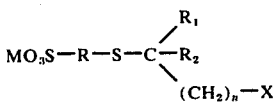

wherein the following definitions delineate the scope of the above general formula:

M= Na,K,$NH_4$or H;

R= an alkylene group containing 2 to 4 carbon atoms;

$R_1$= H, or alkyl group containing 1 to 4 carbon atoms;

$R_2$= H, or $(CH_2)_m$X;

$m$ = 1–2

X= —CN, or

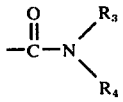

$R_3$,$R_4$ = H, or alkyl group containing 1 – 4 carbon atoms;

n = 0 to 3, with the proviso that when two X groups are present in the compound they are identical.

In general, these compounds may be prepared by the reaction of a mercapto alkyl sulfonate with unsaturated nitrile or an amide by the addition of the mercapto group across the double bond of the unsaturated nitrile or amide. The process takes place preferably in the presence of a copper catalyst although one may not be used. The reaction normally takes place in an aqueous system in basic media, preferably having a pH of from 7.5 to 10.

Exemplary of such products, while not limiting the scope of the general formula which may be used in the present process, are the following:

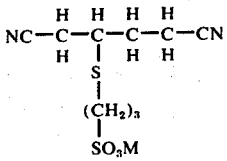

(1)

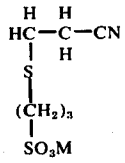

(2)

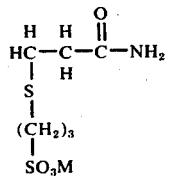

(3)

-continued

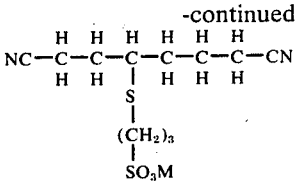

(4)

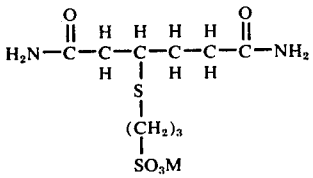

(5)

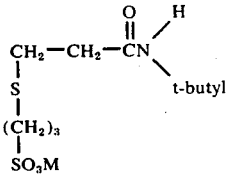

(6)

Of these, particularly good results have been obtained when using the reaction product of mercaptan propane sulfonate and dicyanobutene or acrylonitrile. Accordingly, although specific reference may be made hereinafter to these materials as being preferred for use in the present method, this is not to be taken as a limitation on the thioethersulfonates of nitriles or amides which may be used but merely as being exemplary of those materials.

The three-layered nickel composite coating produced by the method of the present invention may be made with a dull Watts nickel as the lower layer and a dull, semi-bright or bright nickel as the upper layer, provided that the upper layer has, as has been previously indicated, a higher sulfur content than the bottom layer. Although improved corrosion protection is obtained with this 3-layered nickel containing coating in the absence of a final chromium plate, in many instances it is preferred that the upper nickel layer is covered with a final thin bright conventional chromium, or micro-cracked or micro-porous chromium plate, desirably of a thickness of from about 0.005 to 0.2 mils. In general, it has been found desirable that the lower nickel containing layer be thicker than the upper layer, the preferred ratio being from about 50:50 to 80:20 to obtain the best ductility of the coating. Where, however, ductility is not or primary concern, the lower layer may be thinner than the upper nickel containing layer, ratios of about 40:60 being typical, and still obtain excellent corrosion protection of the base metal surface.

It is to be appreciated that in addition to the sulfur, the nickel containing layers making up the composite coating of the present invention may also contain small percentages of other components as are typically present in such coatings, such as carbon, selenium, tellurium, zonc, cadmium, iron and the like. Additionally, these nickel containing layers may also contain appreciable quantities of cobalt, e.g., amounts up to at least as high as 50% cobalt may be present in the nickel containing electroplate layers. Frequently, however, it has been found to be desirable that the lower nickel containing electroplate be as pure nickel as possible.

Accordingly, the lower nickel containing electroplate may be produced from a Watts-type nickel plating bath, a fluoroborate, a high chloride, a sulfamate nickel plating bath or a substantially sulfur-free semi-bright nickel plating bath. The electroplating baths from which the intermediate nickel containing plate is desposited may be of the same type used for the deposition of the lower nickel containing plate or it may be an alkaline nickel electroplating bath or a high sodium, ammonium, lithium or magnesium content type nickel plating bath. The baths from which this intermediate nickel containing electroplate is produced will of course, contain one or more of the thioethersulfonates of nitriles or amides, in the amounts which have been indicated hereinabove, to provide the amount of sulfur which is desired in this intermediate layer. Similarly, the electroplating baths from which the upper nickel plate is deposited may be similar to those used for plating the intermediate layer except, of course, that the concentrations of the sulfur compound, such as the thioethersulfonates of nitriles of amides, will be lower than those used in the bath for plating the intermediate layer. Moreover, where it is desired to provide a decorative plate, the upper nickel containing layer is desirably produced from a bright nickel plating bath that employs one or more of the organic sulfo-oxy compounds set forth in Table II of U.S. Pat. No. 2,512,280 and Table II of U.S. Pat. No. 2,800,440, which compounds are also preferably used with unsaturated compounds or amines to give both leveling and brillance.

These plating baths may also contain other components, such as wetting agents to prevent pitting, buffers, such as boric acid, formic acid, citric acid, acetic acid, fluoboric acid, and the like. These plating baths may typically be operated at temperatures within the range of from about room temperature, i.e., about 20° C, to at least about 85° C and at pH values for acidic baths within the range of about 1–6. It is to be appreciated that the electroplating baths of the present invention will be operated in the manner set forth in U.S. Pat. No. 3,090,733 to produce the composite nickel-containing three layered coating. It is found, however, that by using the particular sulfur containing compounds which have been described hereinabove, rather than those compounds set forth in the issued patent, faster plating speeds are possible, through the use of air agitation, and higher temperatures, and metal impurities, such as zinc, copper and lead maay be electrolytically removed from the plating baths without first destroying the organic sulfur compounds. Thus, it is seen that the process of the present invention may be operated in the manner as set forth in U.S. Pat. No. 3,090,733 to provide a three layered nickel plate on steel, aluminum, zinc, magnesium, brass, and similar base metals which are susceptible to corrosion, but represents an improvment over the process set forth in that patent through the use of certain specific and particular sulfur containing compounds which have been found to be unique when compared to the compounds typically disclosed in the patent.

In order that those skilled in the art may better understand the present invention and the manner in which it may be practiced, the following specific examples are given. In these examples, unless otherwise indicated parts and percent are by weight and temperatures are in degrees centigrade.

EXAMPLE I

Preparation of Compositions:

One mole of mercapto propane sulfonic acid was placed in one liter of water and was adjusted to a pH of 8.5 with the addition of aqueous sodium hydroxide. To this solution is added 5 grams of copper acetate and 1.1 moles of acrylonitrile and heated to 45° C whereupon an exotherm occurs and the solution temperature rises to 80° C. After about 2 hours, the reaction is completed whereupon the residual unreacted acrylonitrile is removed by vacuum.

In a similar manner, mercapto propane sulfonic acid will react with 1,4 dicyanobutene, acrylamide and N-tertbutyl acrylamide.

EXAMPLE II

Steel panels were plated with a three layered nickel system as follows:

15 μm (0.6 mil) of sulfur free semi-bright nickel having a sulfur content of 0.003%.

1.5 μm (0.06 mil) of high sulfur content nickel having a sulfur content of 0.143% provided by a concentration of 0.05 g/l of the reaction product of mercapto propane sulfonic acid and dicyanobutene in air-agitated nickel solution operated at 145° F.

10 μm (0.4 mil) of bright nickel having a sulfur content of 0.05%.

This desposit was chromium plated with 0.25 μm (0.01 mil) of chromium and subsequently exposed to the Corrodkote accelerated test. After 16 hours one failure point developed whereas similar panels without the high sulfur intermediate layer developed in excess of 25 failure sites.

EXAMPLE III

A desposit similar to that described in Example II was prepared except that the concentration of the reaction product of mercapto propane sulfonic acid and dicyanobutene was increased to 0.1 g/l. The sulfur content of the intermediate deposit was increased to 0.22%. The three layered nickel-chromium deposit again was substantially superior to a deposit of similar thickness which omitted the thin high sulfur intermediate layer.

EXAMPLE IV

Panels were plated with the three layered nickel system as follows:

10 μm (0.4 mil) of sulfur-free semi-bright nickel having a sulfur content of 0.003%.

1.75 μm (0.07 mil) of high sulfur content nickel having a sulfur content of 0.16% provided by a concentration of 0.09 g/l of sodium nitrilo-propane mercapto propane sulfonate in an air-agitated nickel solution having a solution temperature of 140° F.

10 μm (0.4 mil) of bright nickel having a sulfur content of 0.05%.

This deposit was chromium plated with 0.25 μm (0.01 mil) of chromium and subsequently exposed to the CASS test. After 20 hours, no points of penetration to the basis metal developed whereas similar panels without the high sulfur intermediate layer had in excess of 14 failure points.

EXAMPLE V

Panels were prepared with the three layered nickel deposits and chromium exactly as described in Example I except that the high sulfur deposit was plated from (1) a non-air agitated Watts type nickel solution at 115° F using 0.2 g/l of benzene sulfinate (U.S. Pat. No.

3,090,733), and (2) an air agitated Watts type nickel solution at 145° F using 0.045 g/l of the reaction product of mercapto propane sulfonic acid and dicyanobutene.

Upon exposure to 32 hours of the Corrodkote accelerated test the panels plated with the high sulfur strike utilizing benzene sulfinate developed 100 points of failure to rust, while the panels plated with the high sulfur strike utilizing the reaction product of mercapto propane sulfonic acid and dicyanobutene developed about 25 points of failure.

EXAMPLE VI

Comparative test on the stability of addition agents used in Examples V, I and III, in hot nickel solutions, showed the following:

1. After being held for 16 hours in a nickel solution at a pH of 1.5 and a temperature of 135° F, 47% of the benzene sulfinate present was oxidized while
2. after being held 24 hours under similar conditions no loss of the sodium nitrilo-propane mercapto propane sulfonate occurred.

EXAMPLE VII

In order to test the plating ability of the compounds of the present invention an air agitated Watts nickel bath having a pH of 2.2 was prepared. The reaction product of mercapto propane sulfonic acid and N-tert-butyl acrylamide (compound No. 8) was placed in the bath at a concentration of 40 mg/l. Into a similar bath at an equal concentration was placed the reaction product of mercapto propane sulfonic acid and acrylamide (compound No. 3). The results indicated that the N-tertbutyl produce was more ductile than the acrylamide product but was not as lustrous. By adding 0.25 g/l of saccharin to each bath, the sulfur content was raised to 0.082%. The plating results showed that the baths were equal.

While there have been described various embodiments of the invention, the specific compositions and processes set forth herein are not be taken as limiting the scope of this invention but merely as being exemplary thereof.

What is claimed is:

1. A thioethersulfonate independently selected from

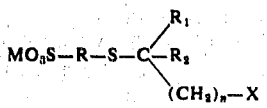

wherein the following definitions delineate the scope of the above general formula:

M = Na, K, $NH_4$ or H;

R = an alkylene group containing 2 to 4 carbon atoms;

$R_1$ = H, or alkyl group containing 1 to 4 carbon atoms;

$R_2$ = H, or $-(CH_2)_m-X$;

m = 1 – 2

X = -CN, or

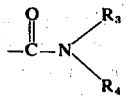

$R_3$, $R_4$ = H, or alkyl group containing 1 – 4 carbon atoms;

$n$ = 0 to 3 with the proviso that when two X groups are present in the compound they are identical.

2. The thioethersulfonate of claim 1, wherein R is three carbon atoms.

3. The thioethersulfonate of claim 1, wherein $R_3$ and $R_4$ are hydrogen.

4. The thioethersulfonate of claim 1, of the structure:

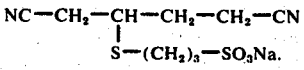

5. The thioethersulfonate of claim 1, of the structure:

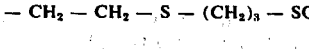

6. The thioethersulfonate of claim 1, of the structure:

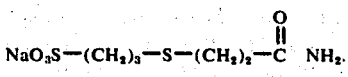

7. The thioethersulfonate of claim 1, of the structure:

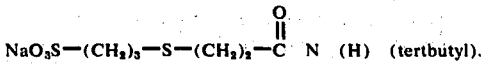

* * * * *